US005410393A

United States Patent [19]

Watanabe

[11] Patent Number: 5,410,393

[45] Date of Patent: Apr. 25, 1995

[54] IMAGE FORMING APPARATUS

[75] Inventor: Toshio Watanabe, Yokohama, Japan

[73] Assignee: Canon Kabushiki Kaisha, Tokyo, Japan

[21] Appl. No.: 18,528

[22] Filed: Feb. 17, 1993

[30] Foreign Application Priority Data

Feb. 17, 1992 [JP] Japan ..... 4-029274

[51] Int. Cl.[6] ..... G03G 15/14

[52] U.S. Cl. ..... 355/273; 355/274; 355/277

[58] Field of Search ..... 355/273, 274, 277, 271, 355/272, 315; 361/214, 235

[56] References Cited

U.S. PATENT DOCUMENTS

| | | | |
|---|---|---|---|
| 3,970,381 | 7/1976 | Meagher et al. | 355/315 |
| 4,166,691 | 9/1979 | Ebi et al. | 355/271 X |
| 4,190,348 | 2/1980 | Friday | 355/274 |
| 4,843,423 | 6/1989 | Nakamura et al. | 355/274 X |
| 4,979,000 | 12/1990 | Hamada et al. | 355/315 |
| 5,132,738 | 7/1992 | Nakamura et al. | 355/274 |
| 5,182,604 | 1/1993 | Asai | 355/273 |
| 5,200,784 | 4/1993 | Kimura et al. | 355/274 |
| 5,287,149 | 2/1994 | Hoshika | 355/274 X |

*Primary Examiner*—A. T. Grimley
*Assistant Examiner*—Nestor R. Ramirez
*Attorney, Agent, or Firm*—Fitzpatrick, Cella, Harper & Scinto

[57] ABSTRACT

An image forming apparatus according to the present invention includes an image bearing member, a latent image forming device for forming an electrostatic latent image on the image bearing member, a developing device for developing the latent image into a toner image with toner charged to a polarity which is the same as the charging polarity of the latent image, and a transfer charger for electrostatically transferring the toner image from the image bearing member onto a transfer material. According to the present invention, the transfer charger is supplied with a voltage having the same polarity as that of a potential of the image bearing member contacted with an end of the transfer material when the end of the transfer material is at a transfer position. Moreover, in the case that a part other than a leading or trailing end of the transfer material is at the transfer position, the transfer charger is supplied with the voltage having an opposite polarity to the image bearing member.

19 Claims, 8 Drawing Sheets

IMAGE FORMING APPARATUS

FIELD OF THE INVENTION AND RELATED ART

The present invention relates to an image forming apparatus such as an electrophotographic copying machine or laser beam printer, more particularly to an image forming apparatus comprising transfer means for transferring a developed image from an image bearing member onto a transfer member, wherein the transfer material is separated from the image bearing member.

As for the method of separating the transfer material from an image bearing member, there are generally three methods.

In a first method, the curvature of the image bearing member is increased to separate the transfer material by the rigidity of the transfer material itself; in the second method, the transfer material is mechanically forced to separate; and in the third method, the transfer material is electrically discharged by a corona charger to remove the electrostatic attraction force of the transfer material to the image bearing member. According to the first method, the transfer material sometimes moved with the image bearing member when the rigidity of the transfer material is low, when the ambient condition is low humidity in which the transfer material is easily charged, when a leading edge of the transfer material is curled toward the image bearing member. If this occurs, the transfer material is not separated. In the case where the image bearing member has an evaporated or applied photoconductive material (Se, CdS, an organic photoconductor), the photosensitive material is not easily contacted to a base member if the curvature of the bases increased. Then, the photoconductive material is easily removed from the base.

In the second method, a belt is interposed between the transfer material and the image bearing member, and therefore, non-image area exists along a lateral edge of the transfer material, the width being 5–8 mm. Since the belt and the image bearing member are directly contacted, the image bearing member may be damaged. According to the third method, the non-image area does not exist. However, the separating operation is not stable. Since the image bearing member and the transfer material are electrostatically attracted, a corona discharge is applied by a separation corona discharger onto the transfer material, the corona discharger being supplied with a DC voltage having a polarity opposite to that of the charge polarity of the transfer material, an AC voltage or an AC voltage biased with the opposite polarity DC voltage, and the separation charger being disposed after the transfer station. By doing so, the attraction force is reduced. However, where the transfer material is separated from an image bearing member having a curvature, immediately after the image transfer action, there is a limit in bringing the corona discharger close to the image bearing member. Therefore, air flow means or the like is also used, with the result of expensive apparatus, difficulty in use in a small size machine. In addition, the separating operation is not stable in view of the ambient condition change.

The foregoing is directed to the separation of a leading edge of the transfer material, but there is a similar problem as to the trailing edge of the transfer material. Sometimes, the trailing edge separation is not good in any of the above three methods. Particularly in the case of a small size image forming apparatus, the first method is preferred in which the curvature of the image bearing member is increased to separate the transfer material by the rigidity of the transfer material itself, from the standpoint of low cost. However, when the transfer material is net rigid, when the transfer material is easily charged electrically because of low humidity condition or when the trailing edge of the transfer material is curled toward the image bearing member with low transfer material feeding speed after the image transfer, a loop of the transfer material is formed with the result that the trailing edge is moved along the image bearing member. If this occurs, an edge of the trailing end of the transfer material rubs the image bearing member, and is contaminated. The contamination is very conspicuous when the transfer materials are piled up. In addition, the transfer material once rise and falls onto the conveying passage, and therefore, the image thereon may be disturbed.

SUMMARY OF THE INVENTION

Accordingly, it is a principal object of the present invention to provide an image bearing member in which the transfer material is separated from an image bearing member in good order.

It is another object of the present invention to provide an image forming apparatus in which the image is not disturbed.

It is a further object of the present invention to provide an image forming apparatus in which an end portion of the transfer material is electrically repelled from an image bearing member.

These and other objects, features and advantages of the present invention will become more apparent upon a consideration of the following description of the preferred embodiments of the present invention taken in conjunction with the accompanying drawings,

DESCRIPTION OF THE PREFERRED EMBODIMENTS

Figure 2:
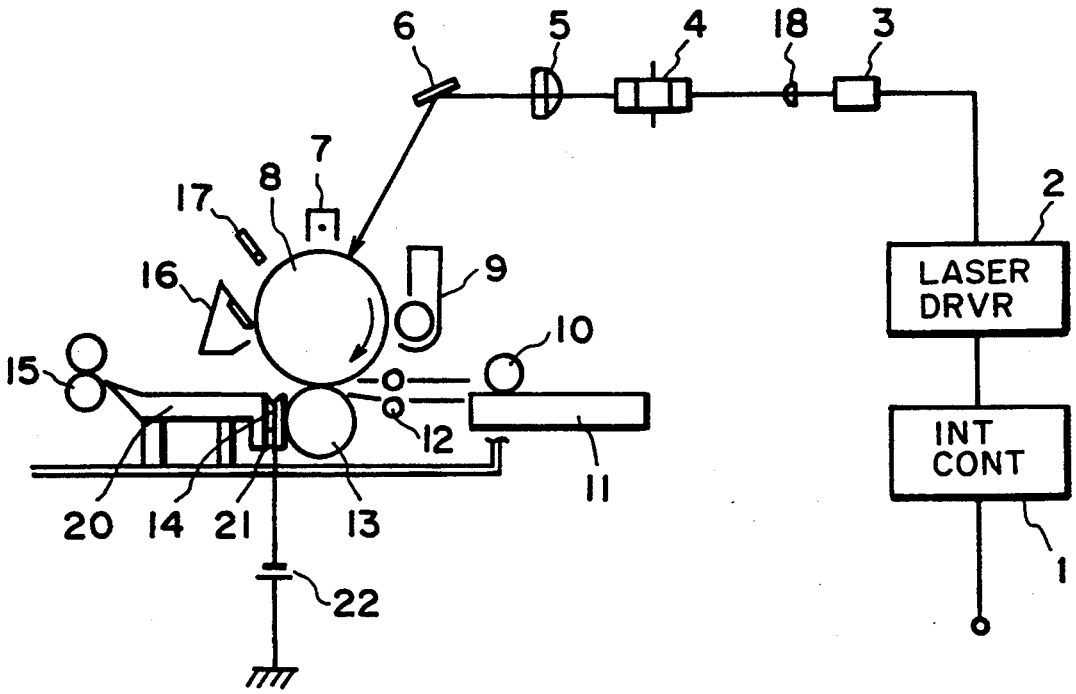
FIG. 2 is a general arrangement of an example of an image forming apparatus with which the present invention is usable.

Referring to the accompanying drawings, embodiments of the present invention will be described in conjunction with the accompanying drawings. The image forming apparatus of this invention is, for example, a laser beam printer which is an exemplary image forming apparatus using a laser beam and an electrophotographic process, as shown in FIG. 2.

The laser beam printer comprises an interface controller 1, a laser driver circuit 2, a laser diode 3, a polygonal mirror 4, an f-$\theta$ lens 5, a reflection mirror 6, a charger 7, a photosensitive drum 8 as the image bearing member, a developing device 9, a sheet feeding roller 10, a paper cassette 11, a register roller 12, a transfer roller 13, discharging needles 14, a fixing device 15, a cleaner 16, an LED array 17, a collimator 18, a fixing device inlet guide 20, a discharging needle holder 21, a voltage source for applying a voltage to the discharging needles 22.

The character or image information in the form of an electric signal supplied from an unshown host computer, is fed to the interface controller 1, and is processed. The output thereof is supplied to a laser driver circuit 2 to emit a laser beam from the laser diode 3. The laser beam is converged to the collimator lens 18, and is projected onto a polygonal mirror 4 which is rotating. The laser beam is projected onto the photosensitive drum 8 by way of the f-$\theta$ lens 5, a correcting optical system (not shown) for correcting influence of tilting of surface of the polygonal mirror 4 and a reflection mirror 6. The laser beam scans the photosensitive member in a direction perpendicular to the peripheral movement of the photosensitive drum 8.

The photosensitive drum 8 is uniformly charged by a charger 7, and then is exposed to the above-described laser beam. Where it is exposed to the laser beam, the electric charge on the photosensitive drum 8 attenuates, but where it is not exposed to the laser beam, the electric charge remains on the photosensitive drum, and therefore, an electrostatic latent image is formed in accordance with on and off of the laser diode 3.

The developing device 9 supplies the developer (not shown) to the electrostatic latent image, so that the image is developed on the photosensitive drum 8. The developed or visualized image is transferred onto a transfer material (not shown). The transfer material is picked up one-by-one by a pick-up roller 10 from a sheet cassette and is brought into contact to the photosensitive drum 8 at a predetermined timing by the registration roller 13. Then, the image is transferred onto the transfer material by the transfer roller 13. The transfer material is separated from the drum 8 by the weight of the transfer material and by the electric discharge of the discharging needles. Them image is fixed on the transfer material by the image fixing device 15. The transfer material is then discharged to an unshown tray.

After the transfer operation, the photosensitive drum 8 is cleaned so that the residual developer or the like is removed by the cleaner 16, and is subjected to a uniform exposure by an LED array 17 so that the residual electric charge is removed therefrom, by which the next image forming process is possible.

Figure 1:
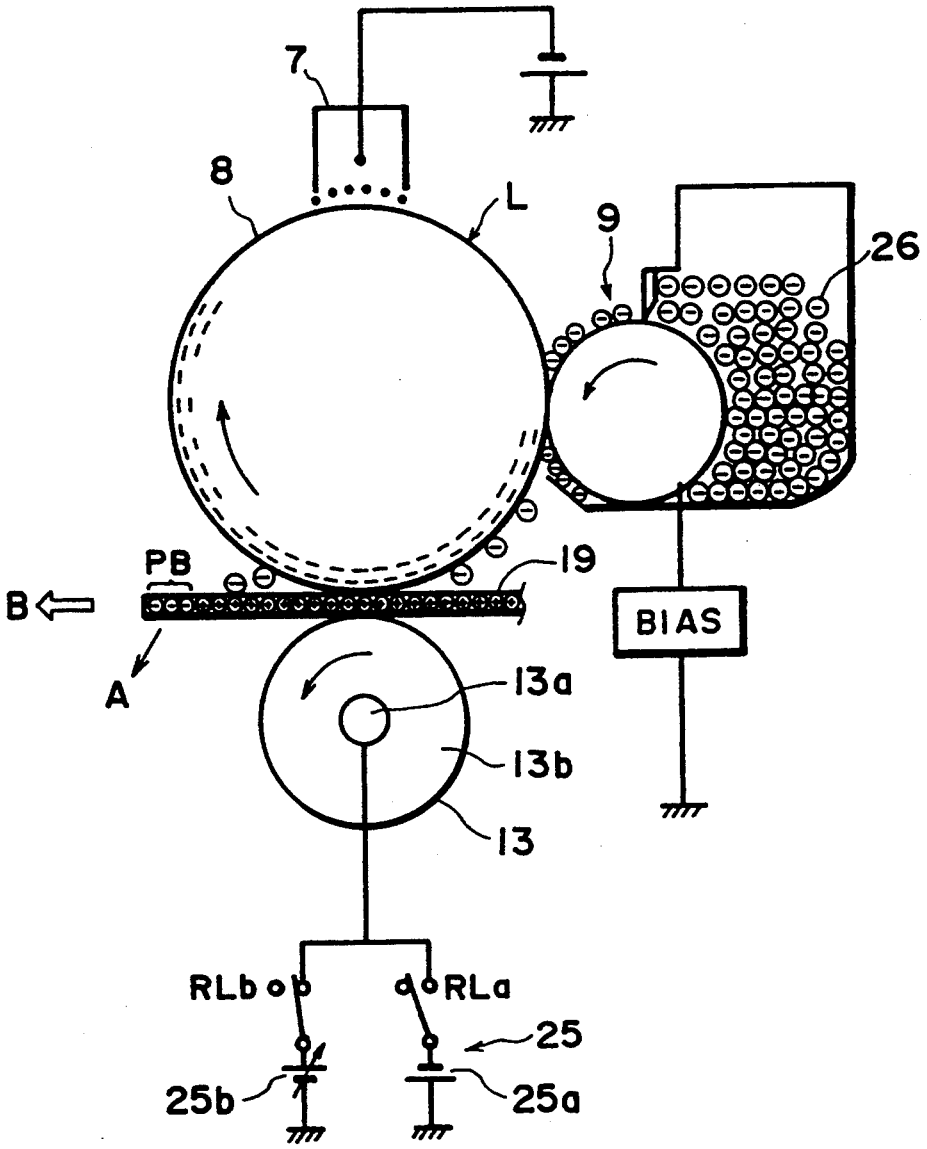
FIG. 1 is a side view of a major part of an image forming apparatus according to a first embodiment of the present invention.

Referring to FIG. 1, the latent image formation, development and transfer steps will be described in detail. The surface of the photosensitive drum 8 having a diameter of 30 mm and made of organic photoconductive material having a negative charging property, is supplied with an electric charge from a corona charger 7 with a grid. The electric charge is of the negative polarity and is uniformly applied on the surface of the photosensitive drum surface. The portion corresponding to the black (character) portion of the image, that is, the portion which will be deposited with the toner, is illuminated by laser beam L, so that the electric charge thereof attenuates. The developer 26 of the negative polarity is deposited to that portion (image exposure (reverse development)). In this manner, a visualized image is formed on the photosensitive drum 8.

Figure 3:
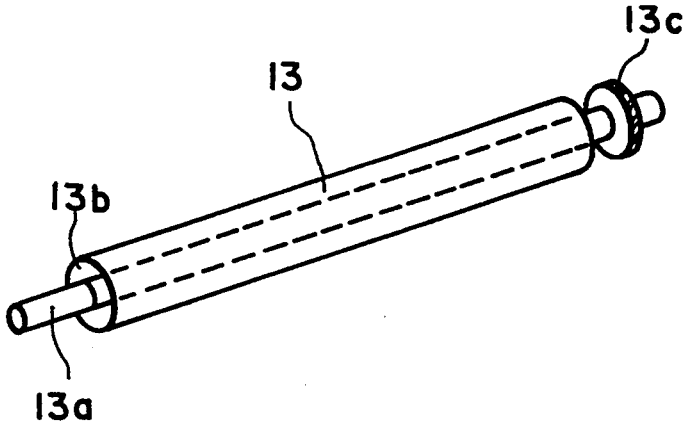
FIG. 3 is an enlarged perspective view of a transfer roller of FIG. 2.

As shown in FIG. 3, the transfer roller 13 comprises a Core metal **13*a* (12 mm in diameter), a rubber elastic layer 13*b* (4 mm in rubber thickness) made of EPDM (ethylene propylene diene terpolymer) in which conductive material such as carbon is dispersed to control the electric resistivity, a helical gear 13*c*** for transmitting driving force from a photosensitive drum gear to the transfer roller. The volume resistivity of the rubber is $10^5$–$10^{15}$ ohm.cm.

In FIG. 1, a reference numeral 25 designates a bias voltage applying means, which comprises a separation bias voltage source **25*a* for applying a separation bias voltage to the non-image region PB (FIG. 4) of a leading edge of the transfer material (with respect to the movement direction B of the transfer material), a transfer bias voltage source 25*b* for applying a transfer bias voltage in the image region PA, relay contacts RLa and RLb for applying proper voltage to the transfer roller 13 from the voltage sources 25*a* and 25*b***. The separation bias voltage supplies a voltage of a polarity opposite from that of the transfer bias voltage, and therefore, the polarity is the same as that of the image bearing member (negative).

The transfer material is fed at a speed of 37 mm/sec in synchronism with the register roller to the drum 8, and is brought into contact with the drum 8 at the transfer position. At this time, as shown in FIG. 1, the transfer roller 13 is contacted to that side of the transfer material 19 which is opposite from the side thereof contacted to the drum 8. The transfer roller 13 (diameter of 20 mm) is supplied with −1000 V from the voltage source **25*a* through switch RLa (RLb is off) and through the core metal 13*a***, for the non-image region PB (4–5 mm from the leading edge of the transfer material). Particularly in the image forming apparatus using transfer roller, it is usually provided with a voltage source having a polarity opposite from that of the bias voltage for the image transfer for the pre-rotation or post-rotation period in which the transfer roller is cleaned. Such a opposite polarity voltage source may be conveniently used. In other words, before the transfer material reaches the transfer position, the transfer roller is continuously supplied with the negative voltage until the leading edge of the transfer material reaches the transfer position. The voltage may be changed, as an alternative structure. The structure of the bias voltage applying means may be of different type.

Figure 4:
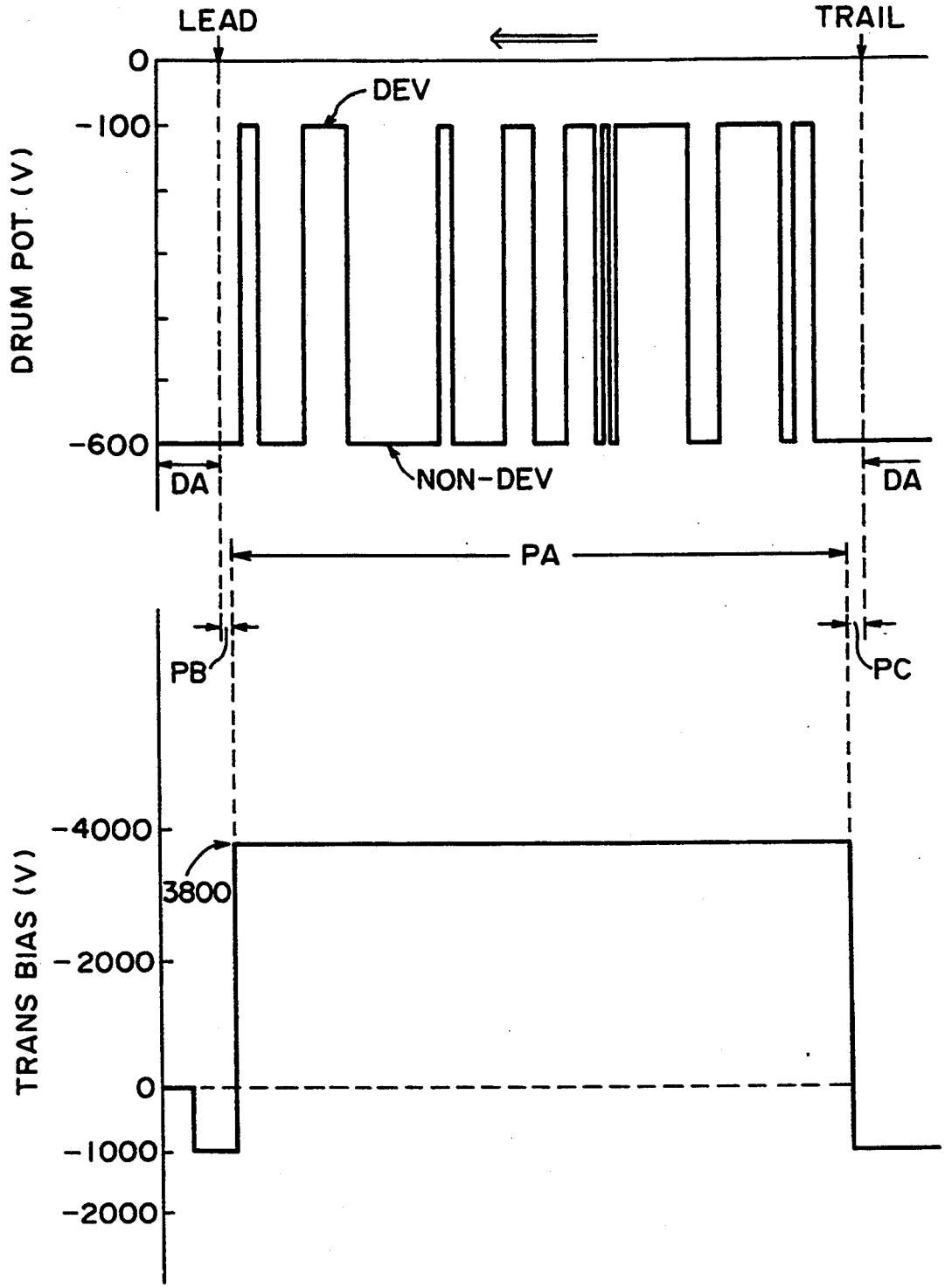
FIG. 4 is an illustration of a drum potential corresponding to the transfer material in an image forming apparatus according to an embodiment of the present invention.

In FIG. 4, the relation between the potential of the photosensitive drum and the transfer bias voltage is shown in a developed view of the photosensitive drum for the better understanding. In the upper part of FIG. 4, the surface potential change of the photosensitive drum in the circumferential direction is shown in association with the transfer material. The lower part show the correspondence between the transfer bias voltage and the transfer material, more particularly, the potential of the drum in contact with the transfer material at the transfer position, is shown. As shown in the Figure, more developer is deposited to the lower part of the absolute level of the latent image potential. For the non-image region PB of the transfer material, −1000 V is applied, and for the image region PA +3800 V is supplied. Here, the non-image region is a region in which the toner is not deposited irrespective of the image information, and the region of the photosensitive drum to be contacted to this region is not subjected to the image exposure. The image forming region is a region in which the toner can be deposited in accordance with the image information.

The region of the drum to be contacted to the non-image region PB and the region PA adjacent thereto and not to contact the transfer material, are charged beforehand to −600 V by the primary charger 7. When the drum region PA is in contact with the transfer roller, the voltage of the transfer roller is −1000 V, and therefore, even if the toner charged to the negative polarity is deposited on the transfer roller, the toner is transferred to the photosensitive drum.

When the non-image region PB at the leading edge of the transfer material is at the transfer position, the transfer roller is supplied with −1000 V, so that the region PB is supplied with a negative charge, and therefore, the potential of the region of the photosensitive drum contacted to the region PB is −600. Accordingly, the photosensitive drum and the leading edge of the transfer material, are electrically repelled from each other, and therefore, the leading edge of the transfer material is separated from the photosensitive drum in good order.

In the foregoing example, the leading edge portion is 4–5 mm, but it may be longer in which case the transfer bias voltage of the same polarity as the potential of the photosensitive drum is applied correspondingly. In addition, the parameter may be changed in accordance with the material of the transfer material or manual switching. Here, the photosensitive drum is used, but it may be a photosensitive belt or the like if it is possible to form a latent image thereon. The developer is not limited, it may be one component toner or two component toner irrespective of the particle size of the toner.

Figure 5:
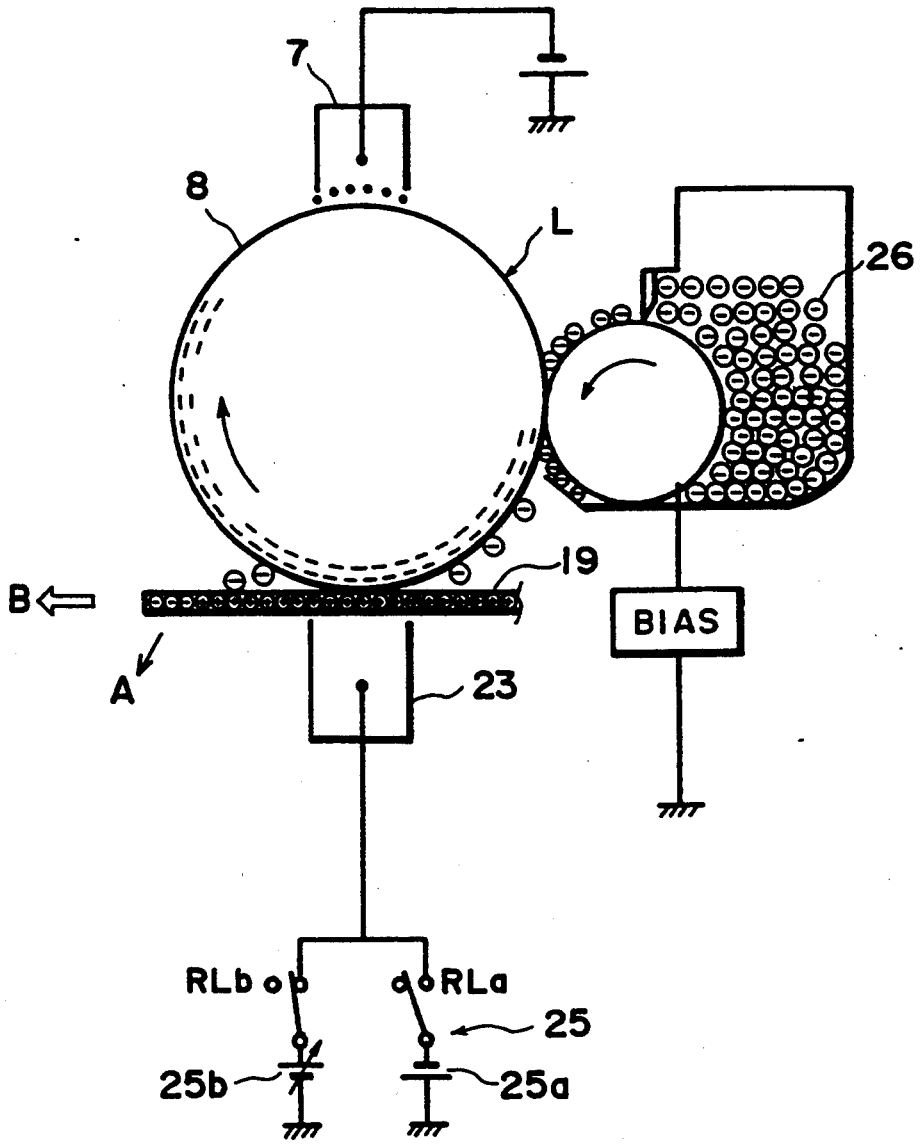
FIG. 5 is a side view of a major part of an image forming apparatus according to a second embodiment of the present invention.

FIG. 5 shows a second embodiment of the present invention. As shown in the Figure, the transfer means is in the form of a corona transfer charger 23 in place of the transfer roller. The switching timing of the high transfer voltage application is the same as in the first embodiment.

Figure 6:
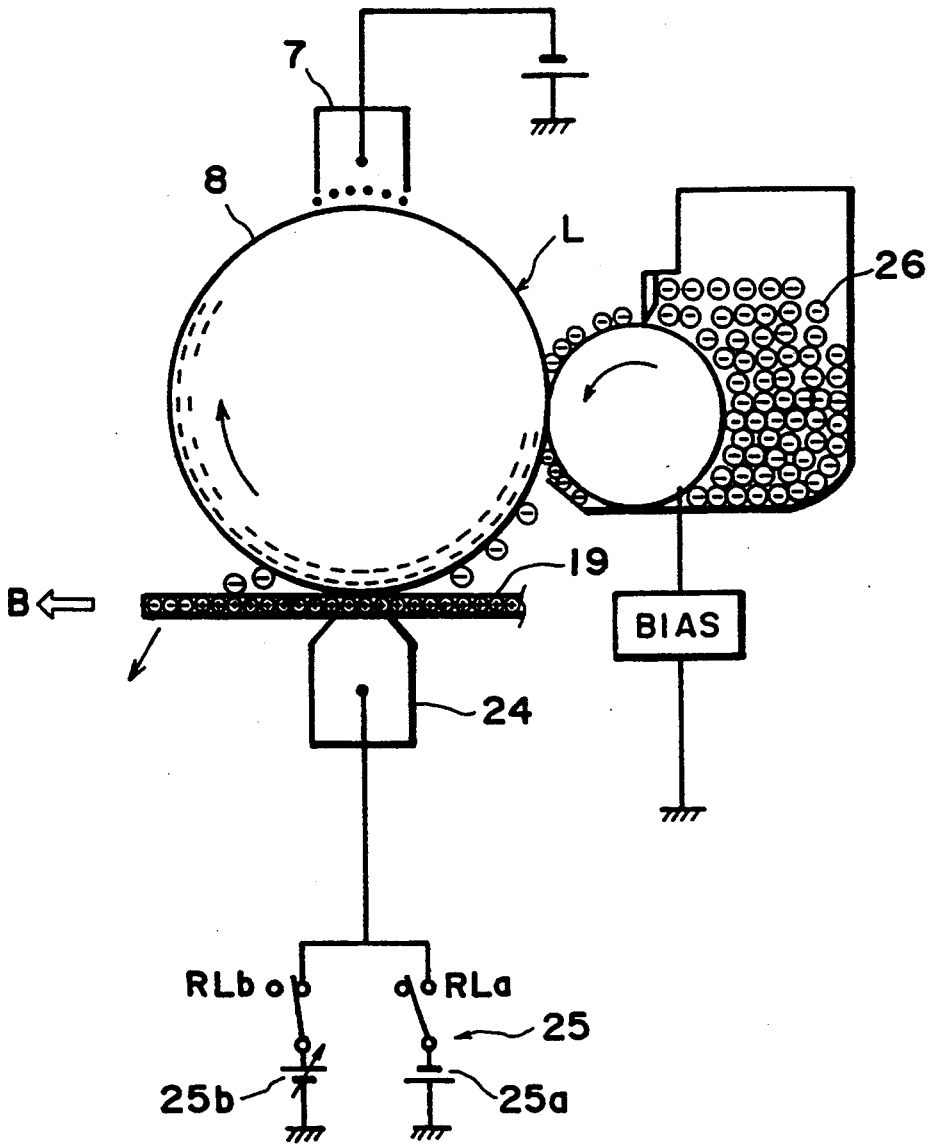
FIG. 6 shows a modification of an apparatus of FIG. 5.

In order to effect sharp switching, the shield of the transfer charger closer to the transfer drum is inclined toward the transfer material as with the corona transfer charger 24, in FIG. 6.

The third and fourth embodiments, will be described in which separation of the non-image region PC (FIG. 4) at the trailing edge of the transfer material 19 is improved.

Figure 7:
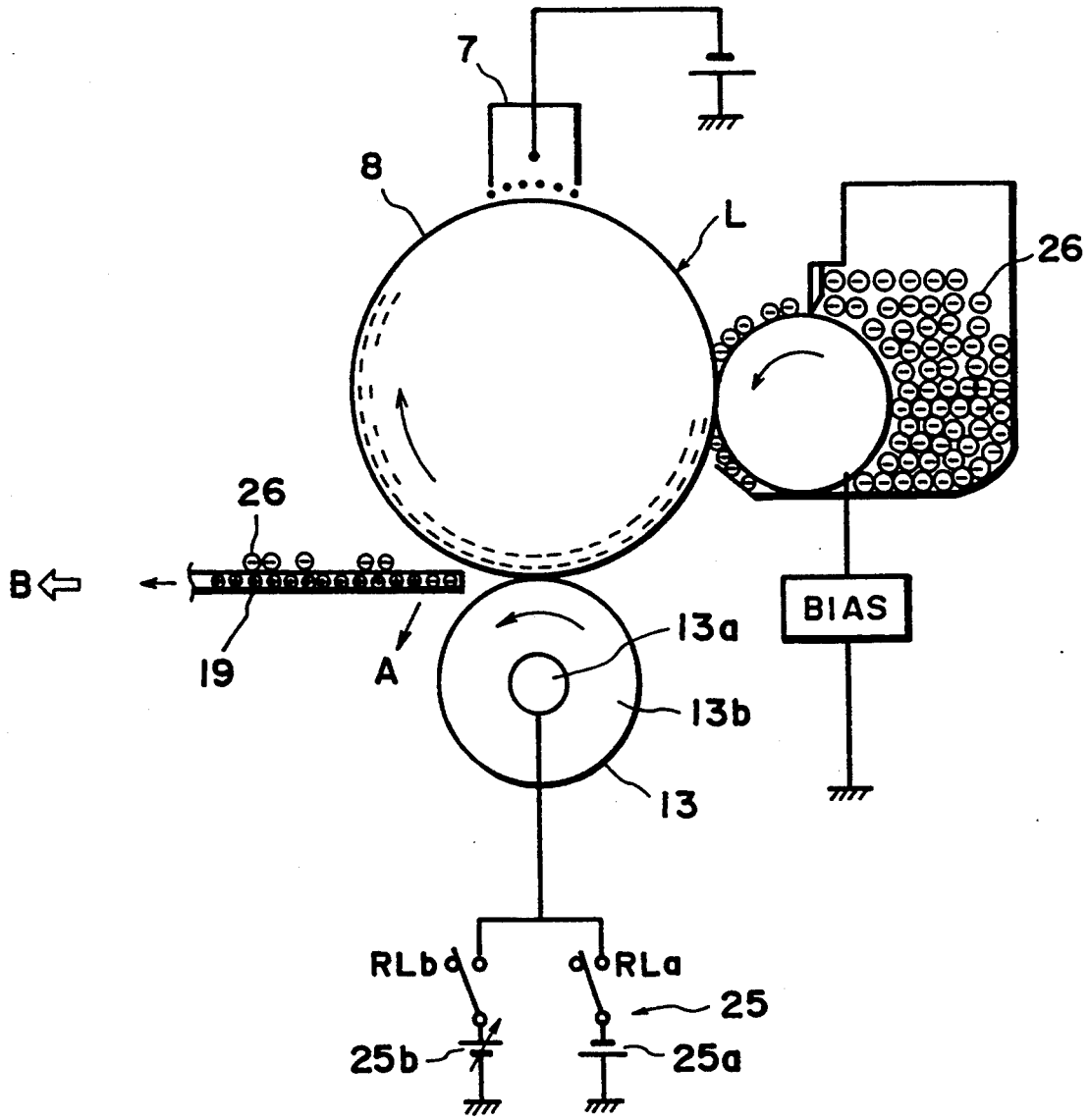
FIG. 7 is a side view of a major part of an image forming apparatus according to a third embodiment of the present invention.

As shown in FIG. 7, in the third embodiment, the non-image region PC at the trailing end portion of the transfer material is supplied with a separation bias voltage through the transfer roller 13, and the voltage in the region PC is the same as the voltage of the image bearing member, and therefore, they are repelled from each other.

FIG. 4 shows the relation between the photosensitive drum potential and the transfer bias voltage in the neighborhood of the trailing end of the transfer material.

Figure 8:
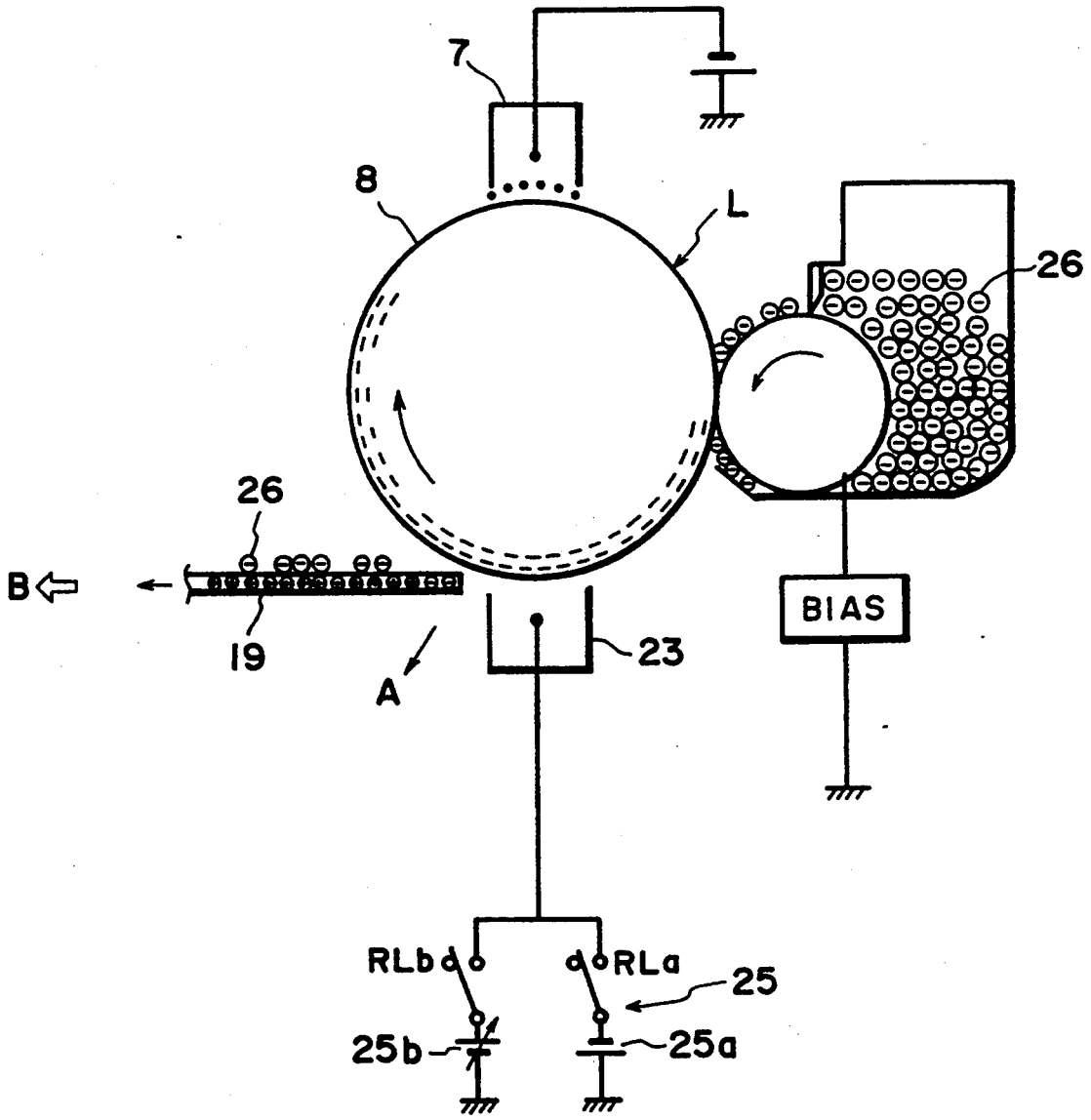
FIG. 8 is a side view of a major part of an image forming apparatus according to a fourth embodiment of the present invention.
Figure 9:
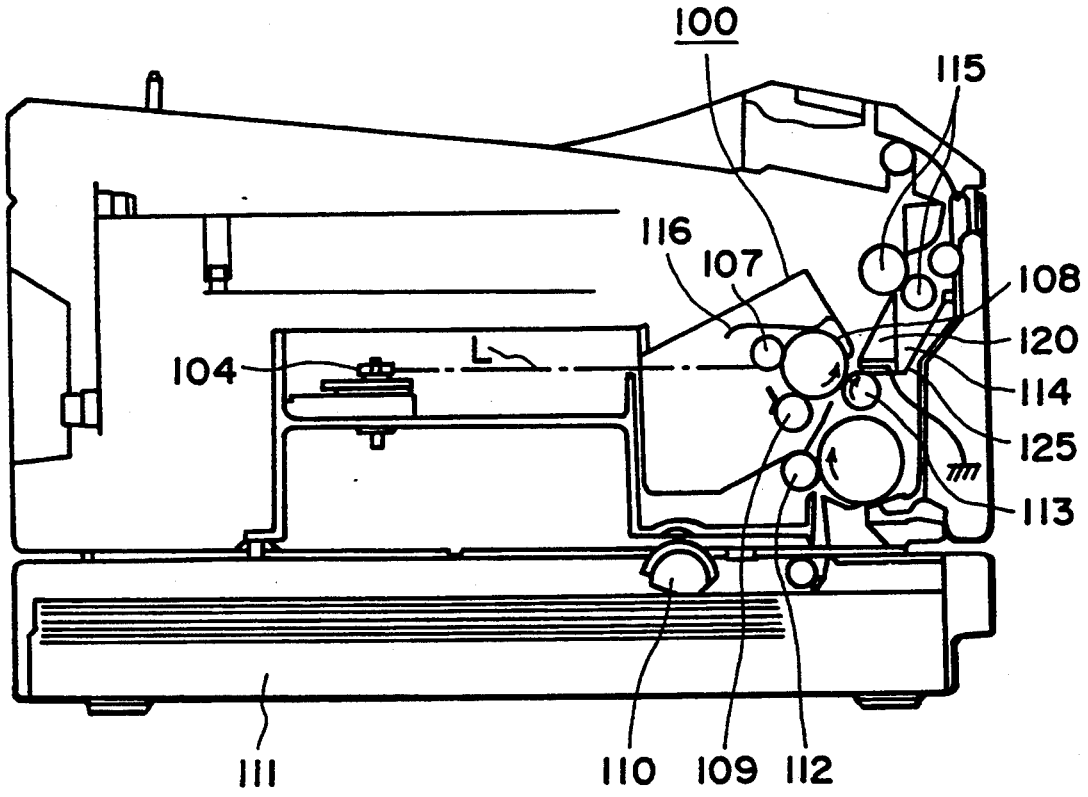
FIG. 9 is a side view of an image forming apparatus according to a fifth embodiment of the present invention.

FIG. 8 shows a fourth embodiment of the present invention, in which the transfer means is in the form of a corona transfer charger 23. The charger 23 may have a reducing structure as shown in FIG. 6. In the foregoing embodiments, the improvements of separations of the non-image regions at the leading and trailing end portions, are effected independently from each other. However, they may be effected simultaneously, although it is not illustrated in the Figure. FIG. 9 shows an embodiment in which the transfer material is fed substantially vertically (0–45 degrees from the vertical line, more particularly 35 degrees in this embodiment) in place of the laser beam printer in which the transfer material is fed substantially horizontally in the foregoing embodiment. No reflection mirror for laser is used. It comprises a cartridge 100 containing a charging means, a developing means, a cleaning means and a photosensitive drum. Designated by reference numerals 107 and 108 are charging roller and image bearing member in the form of a photosensitive drum. Designated by a reference numeral 108 is a developing device. The apparatus comprises a sheet feeding roller 110, a paper cassette 111, a registration roller 112, an image transfer toiler 113, discharging needles 114, fixing device 115, a cleaning 116, a fixing device inlet guide 120 and a discharging needle holder 125.

Character or image information in the form of an electric signal supplied from a host computer (not shown), is supplied to an interface controller (not shown), and is processed. The output thereof is fed to a laser driver circuit (not shown), in response to which a laser diode (not shown) emits light. The laser light L is directed to a collimator lens and is projected to a rotating polygonal mirror 104. The light passes through an f-$\theta$ lens and a correcting optical system (not shown) for correcting tilting of the polygonal mirror, and is incident on the photosensitive drum 108. The light scans the photosensitive drum 108 in a direction perpendicular to the peripheral movement thereof. The photosensitive drum 108 is uniformly charged by a charging roller 107, and thereafter, it is illuminated with the laser light. Where the laser light is projected, the electric charge of the photosensitive drum 108 attenuates, whereas the electric charge remains where the laser light is not projected, and therefore, an electrostatic latent image is formed in accordance with on and off of the laser diode. Subsequently, a developing device 109 supplies the developer (not shown) to the electrostatic latent image, so that a visualized image is formed on the drum 108. The-visualized image is transferred onto a transfer material which has been fed one-by-one by a feeding roller 110 from a paper cassette 111. The transfer material is supplied to the drum 108 into contact therewith in timed relation with the visualized image by a registration roller 112. The tuner image is transferred from the photosensitive drum 108 onto the transfer material. The transfer material is separated with the aid of electric discharge by the discharging needles, from the drum 108. The image on the transfer material is fixed on the transfer material by an image fixing device 115. After the image transfer operation, the photosensitive drum 108 is cleaned by a cleaner 116 so that the residual developer is removed therefrom so as to be prepared for the next image forming process.

In the foregoing embodiments 1–4, the transfer charging means is supplied with a separation bias voltage, by which the separation of the transfer material is improved, More particularly, by the separation bias voltage, repelling force is produced between the leading or trailing edge of the transfer material and the image bearing member, so that the force A is produced as shown in FIGS. 1, 5–8, and the transfer material is fed in the direction B, and at this time, it is separated from the photosensitive drum in good order.

On the transfer material, a central image formation region is defined, and a few millimeter at the leading edge thereof is defined as non-image area. The non-image area is provided for the following reason. The image on the transfer material after the development, transfer and separating operations, is fixed on the transfer material by heat and pressure using a pair of rollers. At this time, if there is an image at the leading edge of the transfer material, the transfer material tends to stack to the fixing roller with the aid of the developer functioning as a binder between the roller and the transfer material. When an image is formed on the transfer material, the conveyance accuracy of the transfer material varies with the result of deteriorated synchronization. This invention utilizes to good advantages the existing non-image region at the leading edge of the transfer material to improve the separation of the leading edge portion. Usually, the non-image region is also provided at the trailing edge (a few mm), in consideration of deteriorated synchronization due to the variation of the feeding of the transfer material. The present invention also utilizes to the good advantages the already existing non-image region at the trailing edge of the transfer material to improve the separation of the transfer material. The edge of the trailing end of the transfer material is prevented from rubbing the image bearing member, thus preventing contamination of the edge. Since the transfer material once rises, and thereafter falls, and therefore, the disturbance to the image can be prevented.

As described in the foregoing, according to the present invention, a separation bias voltage having a polarity opposite from that of the transfer bias voltage is applied by transfer charging means to the non-image area at the leading and/or the trailing edge portion of the transfer material, by which the transfer material is electrically charged to the polarity which is the same as that of the image bearing member. The surface potential of the image bearing member corresponding to the non-image region is high, and the same polarity charge is applied to the leading or trailing edge of the transfer material, so that the repelling force: is produced between the leading or trailing edge of the transfer material and the image bearing member, thus improving the separating operation.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

an image bearing member;

latent image bearing means for forming an electrostatic latent image on said image bearing member;

developing means for developing the latent image into a toner image with toner charged to the polarity which is the same as the charging polarity of the latent image; and transfer charging means for electrostatically transferring the toner image from said image bearing member onto a transfer material, wherein, when the transfer material is moving past the transfer charging means, said transfer charging means is supplied with a voltage having the same polarity as that of a potential of said image bearing member contacted with a trailing end of the transfer material when the trailing end of the transfer material is at a transfer position.

2. An apparatus according to claim 1, wherein, when the transfer material is moving past the transfer charging means, said transfer charging means is supplied with a voltage having the same polarity as that of a potential of said image bearing member contacted with a leading end of the transfer material when the leading end of the material is at a transfer position.

3. An apparatus according to claim 2, wherein said transfer charging means is supplied with a voltage having a polarity opposite from the latent image when a portion of the transfer material other than said leading or said trailing end is at the transfer position.

4. An apparatus according to claim 2, where a polarity of a potential of said image bearing member contacted to either said leading or trailing end has the same polarity as a charging polarity of said latent image.

5. An apparatus according to claim 4, wherein a region of said image bearing member contacted with either said leading or trailing end is charged by said latent image forming means.

6. An apparatus according to claim 4 or 5, wherein a portion of said image bearing member contacted with either said leading or trailing end is free of toner.

7. An apparatus according to claim 4, wherein said transfer charging means is supplied with a voltage having the same polarity as the latent image from the time when the leading end of the transfer material is at the transfer position to the time when the transfer material is not present at the transfer position.

8. An apparatus according to claim 1 or 7, wherein said transfer charging means is contactable to a side of the transfer material remote from said image bearing member.

9. An apparatus according to claim 8, wherein said transfer charging means is contactable to said image bearing member.

10. An apparatus according to claim 8, wherein said transfer charging means is in the form of a roller.

11. An image forming apparatus, comprising:

an image bearing member;

image forming means for forming a toner image on said image bearing member, the toner image being charged to a same polarity as that of a charging polarity of said image bearing member; and transfer charging means for electrostatically transferring the toner image from said image bearing member onto a transfer material, wherein, when said transfer material is moving past said transfer charging means, said transfer charging means is supplied with a voltage having the same polarity as that of a potential of said image bearing member contacted with an end of the transfer material when the end of the transfer material is at a transfer position.

12. An apparatus according to claim 11, wherein said end is a leading end of the transfer material.

13. An apparatus according to claim 11 or 12, wherein said end is a trailing end of the transfer material.

14. An apparatus according to claim 11, wherein said transfer charging means is supplied with a voltage having a polarity opposite from the toner image when a portion of the transfer material other than said end is at the transfer position.

15. An apparatus according to claim 11 or 14, wherein a portion of said image bearing member contacted with said end is free of toner.

16. An apparatus according to claim 11, wherein said transfer charging means is supplied with a voltage having the same polarity as the toner from the time when the end of the transfer material is at the position to the time when the transfer material is not present at the transfer position.

17. An apparatus according to claim 11 or 16, wherein said transfer charging means is contactable to a side of the transfer material remote from said image bearing member.

18. An apparatus according to claim 17, wherein said transfer charging means is contactable to said image bearing member.

19. An apparatus according to claim 17, wherein said transfer charging means is in the form of a roller.

* * * * *